US008602533B2

(12) United States Patent
Fukada et al.

(10) Patent No.: US 8,602,533 B2
(45) Date of Patent: Dec. 10, 2013

(54) INK JET HEAD AND INK JET DEVICE HAVING THE SAME

(75) Inventors: Kazuki Fukada, Osaka (JP); Hidehiro Yoshida, Osaka (JP); Keisei Yamamuro, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/069,752

(22) Filed: Mar. 23, 2011

(65) Prior Publication Data

US 2011/0234705 A1 Sep. 29, 2011

(30) Foreign Application Priority Data

Mar. 26, 2010 (JP) ..... 2010-071959
Jan. 25, 2011 (JP) ..... 2011-012596

(51) Int. Cl.
*B41J 2/045* (2006.01)

(52) U.S. Cl.
USPC ..... 347/68; 347/70; 347/71; 347/72

(58) Field of Classification Search
USPC ..... 347/68–72
See application file for complete search history.

(56) References Cited

U.S. PATENT DOCUMENTS

| | | | | |
|---|---|---|---|---|
| 5,424,769 | A * | 6/1995 | Sakai et al. | 347/70 |
| 5,710,584 | A * | 1/1998 | Suzuki et al. | 347/70 |
| 2008/0238980 | A1 | 10/2008 | Nagashima et al. | |

FOREIGN PATENT DOCUMENTS

| | | | | |
|---|---|---|---|---|
| JP | 3-015555 | | 1/1991 | |
| JP | 4-355147 | | 12/1992 | |
| JP | 6-064163 | | 3/1994 | |
| JP | 6-143573 | | 5/1994 | |
| JP | 6-297700 | | 10/1994 | |
| JP | 7-164640 | | 6/1995 | |
| JP | 07-164640 | * | 6/1995 | B41J 2/175 |
| JP | 8-224874 | | 9/1996 | |
| JP | 11-058731 | | 3/1999 | |
| JP | 2001-010050 | | 1/2001 | |
| JP | 2003-94644 | | 4/2003 | |
| JP | 2003-094644 | * | 4/2003 | B41J 2/045 |
| JP | 2005-262638 | | 9/2005 | |
| JP | 2006-096042 | | 4/2006 | |
| JP | 2008-254196 | | 10/2008 | |

* cited by examiner

*Primary Examiner* — Henok Legesse
(74) *Attorney, Agent, or Firm* — Panasonic Patent Center

(57) ABSTRACT

An ink jet head and an ink jet device having the same are provided, which include an ink supply path supplied with ink from an ink inlet port, an ink discharge path configured to discharge the ink to an ink discharge port, an ink chamber provided to communicate with the ink supply path and the ink discharge path and having a nozzle configured to discharge the ink, and a piezoelectric actuator operable to apply pressure to the ink within the ink chamber by displacement of a vibrating plate of the ink chamber, wherein the piezoelectric actuator is arranged through the vibrating plate of the ink chamber and an island member, the island member is disposed to extend between the ink supply path and the ink discharge path, and a length W1 of a side of the island member on the ink supply path side and a length L that extends from the ink supply path side to the ink discharge path side are different from each other.

3 Claims, 10 Drawing Sheets

INK JET HEAD AND INK JET DEVICE HAVING THE SAME

CROSS REFERENCE TO RELATED APPLICATIONS

This application is entitled and claims the benefit of Japanese Patent Application No. 2010-071959, filed on Mar. 26, 2010 and Japanese Patent Application No. 2011-012596, filed on Jan. 25, 2011, the disclosure of which including the specification, drawings and abstract is incorporated herein by reference in its entirety.

BACKGROUND

1. Technical Field

The technical field relates to an ink jet head and an ink jet device having the same.

2. Background Art

An ink jet head is known as a head that can apply a required amount of ink toward an object in a certain timing in accordance with an input signal. Particularly, since a piezoelectric (piezo) ink jet head can apply many kinds of ink with accurate control, it has been actively developed to date. In general, the piezoelectric ink jet head includes an ink supply path, a plurality of ink chambers communicating with the ink supply path and having a nozzle, and a piezoelectric element that applies pressure to ink filled in the ink chambers. By applying a driving voltage to the piezoelectric element, mechanical deformation occurs on the piezoelectric element, and pressure is applied to the ink inside the ink path to cause the ink to discharge from the nozzle.

For example, as a representative construction of the ink jet head, a construction in which the entire surface of an actuator (piezoelectric element) is installed on a resin film (side wall of an ink chamber) is known, and there is a technique of discharging ink drops from the nozzle by pressing the ink filled in the path through pressing of the resin film by the driving of the piezoelectric element (see FIG. 4 and Paragraph [0079] of JP-A-2006-096042).

Also, as an invention that aims at high density of ink drops, an ink jet recording head as described in JP-A-3-015555 (FIGS. 3 and 4) is known. The ink jet recording head is related to a technique of discharging ink from an ink nozzle by changing the volume of an ink pressure chamber that is formed of a cavity plate through displacement of an $SiO_2$ film portion by pressing an Si projection portion using a piezoelectric actuator (see FIG. 10 of JP-A-3-015555). Also, FIG. 2 of JP-A-2005-262638, FIGS. 1 and 2 of JP-A-11-058731, FIGS. 1 and 2 of JP-A-4-355147, FIG. 1 of JP-A-6-064163, FIGS. 2 and 3 of JP-A-6-297700, Paragraph [0015] of JP-A-6-143573, FIG. 1 of JP-A-8-224874, and FIG. 1 of JP-A-2001-010050 disclose techniques to the effect that a relay member, which is provided between a piezoelectric element and a vibrating plate, extends in one direction, and is arranged to be in contact with a portion of the piezoelectric element. In addition, ink jet heads disclosed in JP-A-2008-254196, JP-A-2000-233502, JP-A-11-077996, US Patent Application Publication No. 2008/0238980, U.S. Pat. No. 6,286,938, U.S. Pat. No. 7,128,406, JP-A-07-178899, JP-A-02-141243, JP-A-10-114081, U.S. Pat. No. 5,956,058, and U.S. Pat. No. 6,609,785 are known.

However, the above-described ink jet heads in the related art have the following problems.

First, the technique described in FIG. 4 and Paragraph [0079] of JP-A-2006-096042 represents a construction in which the actuator (pressing means) is arranged on the entire surface of the pressing plate (vibration plate) that forms the upper surface of the pressure chamber. Because of this, in the construction as in JP-A-2006-096042 (FIG. 4, Paragraph 0079), when ink is discharged from the nozzle, the pressure that is applied from the actuator to the pressure chamber is transferred to not only the nozzle but also other places of the pressure chamber, and thus it may not be possible to concentrate the pressure from the corresponding actuator onto the nozzle portion. Accordingly, in the technology described in JP-A-2006-096042 (FIG. 4, Paragraph 0079), sufficient discharge force may not be provided when the ink is discharged from the nozzle. Also, in JP-A-2006-096042 (FIG. 4, Paragraph 0079), a construction in which the width of the actuator (for example, the width of the actuator 58 in FIG. 4 of JP-A-2006-096042 (FIG. 4, Paragraph 0079)) is narrowed and the actuator is arranged only just above the nozzle 51 may be considered. However, in the construction in which the actuator is simply small-sized, the pressure that is applied to the ink chamber is reduced to that extent, and thus the discharge force of the ink is lowered.

Also, in JP-A-2006-096042 (FIG. 4, Paragraph 0079), it may be considered to narrow the width of the actuator and to heighten the driving voltage that is applied to the actuator. However, if the driving voltage is heightened, the actuator itself has heat, and the temperature of the ink that flows through the ink chamber is heightened to cause a non-preferable result. Also, the heightening of the driving voltage is related to the lifespan of the actuator itself. Also, in the construction in which the width of the actuator is narrowed and the actuator is arranged only just above the nozzle, a desired discharge force is secured by stacking the actuator, but the ink jet head becomes large-sized due to the large actuator to cause a non-preferable result.

Next, FIGS. 3 and 4 of JP-A-3-015555 discloses the construction in which the piezoelectric actuator is connected to the vibrating plate 7 through the Si projection portion 10. Since the technique described in FIG. 3 of this document aims at high density of the ink jet nozzle, the Si projection portion is arranged only in the position that corresponds to the ink nozzle. Accordingly, as shown in FIG. 6B of this document, when the pressure is applied to the ink pressure chamber by the piezoelectric actuator, the pressure is applied in every direction, and thus a portion of the ink flows backward to the ink supply side. This may be a great obstacle to the discharge of the ink from the ink nozzle.

In the techniques described in FIG. 2 of JP-A-2005-262638, FIGS. 1 and 2 of JP-A-11-058731, FIGS. 1 and 2 of JP-A-4-355147, FIG. 1 of JP-A-6-064163, FIGS. 2 and 3 of JP-A-6-297700, Paragraph [0015] of JP-A-6-143573, FIG. 1 of JP-A-8-224874, and FIG. 1 of JP-A-2001-010050, there is no approach to the circulation of ink in the ink jet head. In the structure in which the relay member, which is provided between the piezoelectric element and the vibrating plate, extends in one direction, and is arranged to be in contact with a portion of the piezoelectric element as in FIG. 2 of JP-A-2005-262638, FIGS. 1 and 2 of JP-A-11-058731, FIGS. 1 and 2 of JP-A-4-355147, FIG. 1 of JP-A-6-064163, FIGS. 2 and 3 of JP-A-6-297700, Paragraph [0015] of JP-A-6-143573, FIG. 1 of JP-A-8-224874, and FIG. 1 of JP-A-2001-010050, the ink is simply discharged from the nozzle, and thus, for example, the ink may stay in a corner portion of the ink chamber or may become stiff. Accordingly, the corresponding structure is not sufficient as the ink jet head.

SUMMARY

Embodiments of the present invention have been made in view of the above problems, and an object of such embodiments is to provide an ink jet head and an ink jet device having the same, which combines a strong ink discharge force of ink and circulation of the ink.

The ink jet head and the ink jet device having the same according to an exemplary embodiment of the invention have the following aspects.

According to a first aspect, an ink jet head includes an ink supply path supplied with ink from an ink inlet port; an ink discharge path configured to discharge the ink to an ink discharge port; an ink chamber provided to communicate with the ink supply path and the ink discharge path, and having a nozzle configured to discharge the ink; and a piezoelectric actuator operable to apply pressure to the ink within the ink chamber by displacement of a vibrating plate of the ink chamber, wherein the piezoelectric actuator is arranged through the vibrating plate of the ink chamber and an island member, the island member disposed to extend between the ink supply path and the ink discharge path, and a length W1 of one side of the island member on the ink supply path side is shorter than a length L that extends from the ink supply path side to the ink discharge path side.

Through this construction, an ink jet head that combines a strong discharge force of the ink and circulation of the ink can be realized.

According to a second aspect, if the length W1 of a side on the ink supply path side of the island member is longer than a length W2 of a side on the ink discharge path side of the island member, a difference in ink pressure can be given between the upstream side and the downstream side of the ink in the ink chamber, and thus giving of the ink pressure difference as above is much more preferable on the viewpoint of the ink circulation.

According to a third aspect, if the island member is arrange just above the nozzle that is formed on the ink chamber, the ink discharge force from the piezoelectric actuator can be strengthened with respect to the nozzle, and thus doing so is preferable on the viewpoint of the ink discharge force.

According to a fourth aspect, if it is assumed that the length of a side on the ink supply path side of the piezoelectric actuator is d, the relationship between the length W1 of a side on the ink supply path side of the island member and the length W2 of a side on the ink discharge path side of the island member is represented by $d/4<W(W1,W2)\leq d$.

According to a fifth aspect, it is preferable that the piezoelectric actuator is a stacked piezoelectric element.

According to a sixth aspect, it is preferable that a plurality of ink chambers are arranged in parallel with respect to the ink supply path or the ink discharge path.

According to a seventh aspect, it is preferable that the ink chamber and the ink supply path communicate with each other through an ink supply hole, and the ink supply hole has a spot where at least an aperture of the ink supply hole is changed. Accordingly, the backward flow of the ink from the ink chamber to the upstream side can be preferably suppressed.

According to an eight aspect, it is preferable that an ink jet device is provided with the ink jet head.

According to the above described embodiments of the invention, by forming the island member that is installed opposite to the nozzle so that the length of one side on the ink supply path side of the island member and the length extending from the ink supply path side to the ink discharge path side are made different from each other, a strong ink discharge force can be realized. Also, since the ink supply path is provided on the upstream side of the ink chamber having the nozzle and the ink discharge path is provided on the downstream side of the corresponding ink chamber, the strong discharge force of the ink and the circulation of the ink can be combined.

DETAILED DESCRIPTION

Figure 1:
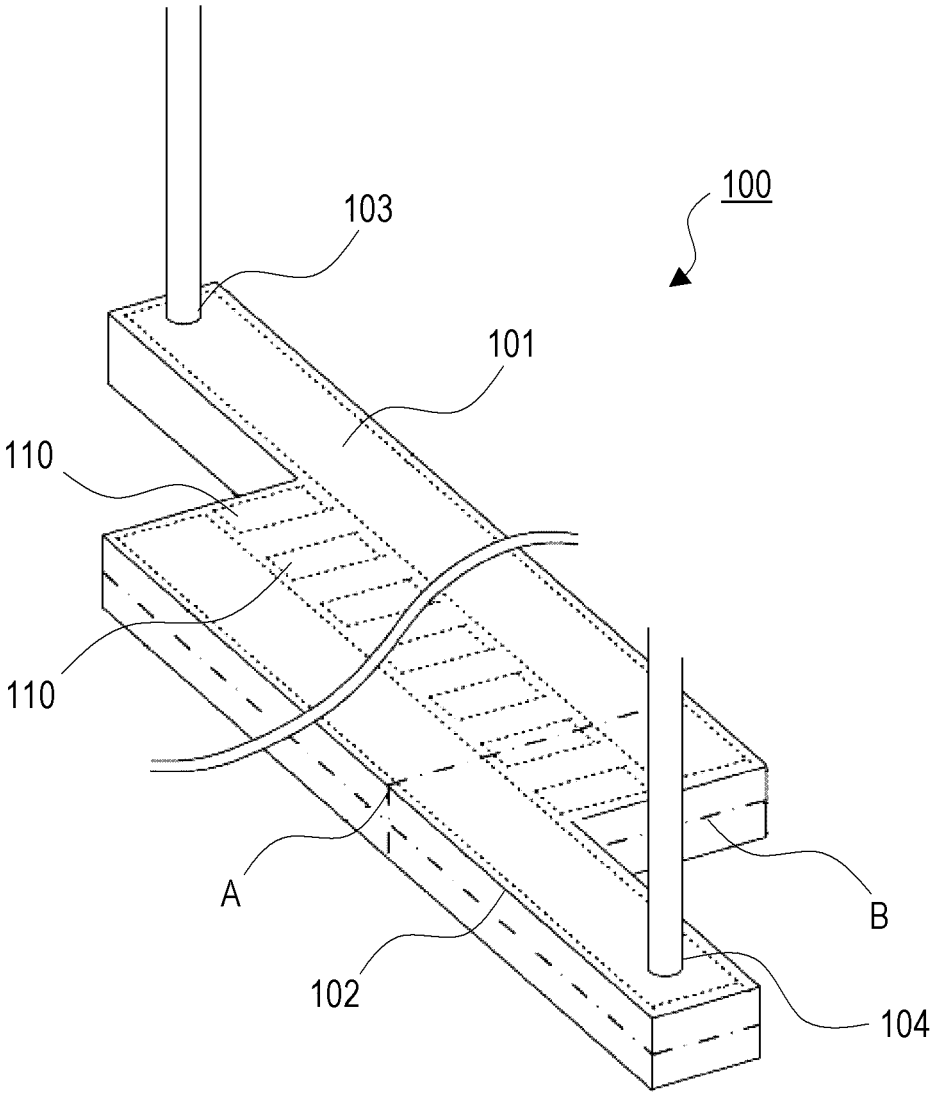
FIG. 1 is a perspective view of an ink jet head according to a first exemplary embodiment of the invention.

1. Regarding an Ink Jet Head:

The ink jet head according to the embodiments of the invention is a drop-on-demand type piezoelectric ink jet head having a plurality of ink chambers. The drop-on-demand type ink jet head is known as an ink jet head that can apply a necessary amount of ink, if any, according to an input signal. In particular, a drop-on-demand type piezoelectric (piezo) ink jet head can apply many kinds of ink with fine control. Also, the ink jet head according to the embodiments of the invention is an ink circulation type ink jet head in which ink flows within an ink chamber.

The ink jet head according to the embodiment of the invention includes an ink supply path, an ink discharge path, a plurality of ink chambers, and a plurality of piezoelectric elements. The plurality of ink chambers are arranged in parallel, and the piezoelectric elements are arranged to correspond to the respective ink chambers. Also, by devising the arrangement position of the piezoelectric element, a vibrating plate, and an island portion (which may be a separate member from a vibrating plate and a piezoelectric actuator or may be integrally formed) that is arranged between a vibrating plate and the piezoelectric element, a strong discharge force of the ink and the circulation of the ink are combined together.

<Basic Construction of Ink Jet Head>

Hereinafter, construction members of the ink jet head will be described.

The ink supply path is a path which has an ink inlet port for supplying ink from the outside and through which the ink to be supplied to the ink chamber flows. The ink supply amount that is supplied to the ink supply path is not specially limited, and may be several ml/min or more. The ink that is supplied to the ink supply path through the ink inlet port is distributed to the plurality of ink chambers.

The ink discharge path is a path which has an ink discharge port for discharging the ink to the outside, and through which the ink discharged from the plurality of ink chambers flow.

The ink chamber is a space for accommodating the ink to be discharged from the nozzle. The ink chamber communicates with the ink supply path and the ink discharge path. The preferable maximum number of ink chambers that communicate with one ink supply path and one ink discharge path is typically 1024.

The ink chamber and the ink supply path are connected to each other through an ink supply hole. The ink chamber and the ink discharge path are connected to each other through an ink discharge hole. Accordingly, the ink in the ink chamber flows from the ink supply hole to the ink discharge hole. Accordingly, new ink is constantly supplied into the ink chamber. As described above, through a constant flow of new ink into the ink chamber, gathering or stopping of the ink and mixing of bubbles with the ink in the ink chamber may be prevented. It is preferable that the flow rate of the ink in the ink chamber is 1 to 200 ml/min. Also, the direction in which the ink flows in the ink chamber may be the direction in which the ink is discharged from the nozzle (hereinafter referred to simply as "discharge direction") (see FIG. 2) or the direction that is roughly perpendicular to the ink discharge direction (see FIG. 4).

The ink chamber has the nozzle. The nozzle is a tube which communicates with the outside and has a discharge hole. One ink chamber may have one nozzle or two or more nozzles. The ink in the ink chamber is discharged from the discharge hole to the outside through the inside of the nozzle. The diameter of the discharge hole is not specially limited, and may be, for example, in the range of 10 to 100 μm, and preferably, about 20 μm.

The kind of ink accommodated in the ink chamber is not specially limited, and is appropriately selected according to the kind of product. For example, in the case where the product is an organic EL panel or a liquid crystal panel, examples of ink accommodated in the ink chamber include a solution that includes an organic light-emitting material such as a light-emitting element or the like and ink having high viscosity such as a liquid crystal material. As described above, the ink jet head according to the embodiments of the invention has a strong discharge force, and thus can sufficiently apply even the high-viscosity ink.

The piezoelectric element is an operation device that displaces a wall surface (vibration plate) of the ink chamber through conversion of a control signal that includes a driving voltage into an actual movement. If a voltage is applied to the piezoelectric element, the height of the piezoelectric element is increased, and pressure is applied to the ink in the ink chamber. Accordingly, the ink can be discharged from the discharge hole of the nozzle.

In the embodiments of the invention, the piezoelectric element may be a thin film piezoelectric element or a stacked piezoelectric element, but it is preferable that the piezoelectric element is a stacked piezoelectric element. The thin film piezoelectric element has a fast output response to an input, but shows a tendency of output lowering. Because of this, the ratio of a loss of discharge force in the ink supply path or ink discharge path is likely to increase. Accordingly, depending on the kinds of ink, an appropriate discharge may not be performed. On the other hand, the stacked piezoelectric element has a slow output response to the input, but it is easy to heighten the output thereof. Because of this, the stacked piezoelectric element is scarcely influenced by the ink pressure in the ink chamber to be discharged, and thus a stable discharge can be realized. The height of the stacked piezoelectric element (the length in the stacking direction) is typically in the range of 100 to 1000 μm.

The stacked piezoelectric element is produced by producing a driving body through stacking of a plurality of layers of sheets of lead zirconate titanate (PZT) and conductive films on the piezoelectric plate and dividing the driving body. In order to divide the driving body, a dicing device having a rotating blade inserted thereto may be used.

<Positional Relationship Between Main Construction Members>

Hereinafter, the arrangement positions of the nozzle, a wall surface (vibration plate) of the ink chamber, an island portion, and the piezoelectric element in the ink jet head according to the embodiments of the invention will be described in detail.

The piezoelectric element is arranged in a position opposite to the nozzle, and is installed on the wall surface (vibration plate) of the ink chamber. In this case, the island portion is arranged between the piezoelectric element and the vibration plate. The island portion may be a separate member from the vibrating plate and the piezoelectric actuator or may be formed by modifying the vibrating plate and the piezoelectric actuator. The island portion is a member that extends in one direction (specifically, in FIGS. 2 and 4, the island portion is a member that extends in a direction that is perpendicular to the surface of a sheet). The piezoelectric element may be partially or entirely in contact with the island portion (see FIGS. 8A to 8C). In the ink jet head according to the embodiments of the invention, the island portion is basically formed just just above the nozzle.

As described above, through arrangement of the nozzle, the vibrating plate, the island portion, and the piezoelectric element, it is possible to combine the strong discharge force and the circulation of the ink.

2. Regarding an Ink Jet Device:

The ink jet device according to the embodiments of the invention is characterized to have the above-described ink jet head and other known appropriate members of the ink jet device. For example, the ink jet device includes a member fixing the ink jet head and a moving stage for placing and moving an object to which the ink is applied.

The ink jet device is provided with an ink circulation device (not illustrated). The ink circulation device circulates the ink by supplying a driving pressure to the ink. In order to supply a driving pressure to the ink, a pump may be used, but it is preferable to use a regulator that supplies pressure using a compressed air. This is because driving pressure becomes constant using the regulator and thus the circulation speed of the ink is stabilized. In the ink jet device according to the embodiments of the invention, it is preferable to seamlessly circulate the ink of the ink jet head during the operation of the device.

Hereinafter, exemplary embodiments of the invention will be described with reference to the accompanying drawings, but the present invention is not limited to those exemplary embodiments.

Embodiment 1

FIG. 1 is a perspective view of an ink jet head 100 according to an embodiment 1 of the invention. As illustrated in FIG. 1, the ink jet head 100 includes an ink supply path 101, an ink discharge path 102, and a plurality of ink chambers 110. Also, the ink supply path 101 has an ink inlet port 103, and the ink discharge path 102 has an ink discharge port 104.

Figure 2:
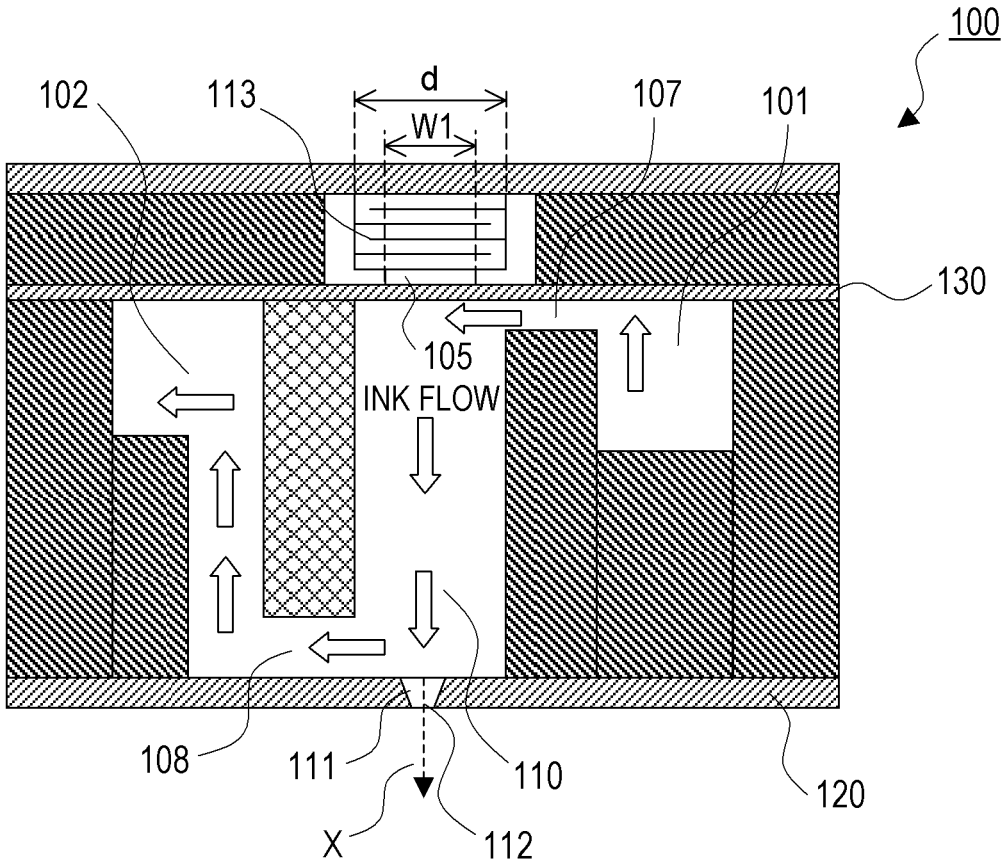
FIG. 2 is a cross-sectional view of the ink jet head according to the first exemplary embodiment of the invention.

FIG. 2 is a cross-sectional view taken along line A of the ink jet head 100 illustrated in FIG. 1. FIG. 3A is a cross-sectional view (plan view) taken along line B of the ink jet head 100 indicated in FIG. 1.

As illustrated in FIGS. 2 and 3A, the ink chamber 110 has a nozzle 111. The ink chamber 110 accommodates ink to be discharged from a discharge hole 112 of the nozzle 111. Also, the ink chamber 110 communicates with the ink supply path 101 through an ink supply hole 107, and communicates with the ink discharge path 102 through an ink discharge hole 108. The ink discharge hole 108 is arranged on the nozzle side relative to the ink supply hole 107. Also, the ink discharge hole 108 is arranged on the nozzle side relative to a stacked piezoelectric element 113 to be described later. Also, both the ink supply hole 107 and the ink discharge hole 108 are installed on the wall surface of the ink chamber 110 along the ink discharge direction X (see FIG. 2).

Also, as illustrated in FIGS. 2 and 3A, the ink jet head 100 includes a stacked piezoelectric element (hereinafter also referred to as a "piezoelectric element") 113 that displaces the wall surface 130 (hereinafter referred to as a "vibrating plate 130") of the ink chamber 110 along the ink discharge direction X. The piezoelectric element 113 is arranged on the outside of the ink chamber 110, and is installed through an island portion 105 that is installed on the vibrating plate 130. The island portion 105 is arranged so as to straddle the nozzle 111.

Next, with reference to FIGS. 3A and 4, the operation of the ink jet head 100 according to the first embodiment of the invention will be described.

First, ink is supplied from an ink tank to the ink supply path 101. It is preferable that the ink tank (not illustrated) has a pressure regulation mechanism (not illustrated). As the ink tank has the pressure regulation mechanism, the ink can be supplied from the ink tank to the ink supply path 101 at constant pressure even if the ink in the ink tank is consumed and an ink liquid surface in the ink tank is lowered. The pressure regulation mechanism may maintain the pressure of the ink being supplied to remain constant by making the height of the ink liquid surface to remain constant through regulation of the height of the ink tank.

The ink supplied to the ink supply path 101 is supplied to the ink chamber 110 through the ink supply hole 107. The ink supplied to the ink chamber 110 is then discharged to the ink discharge path 102 through the ink discharge hole 108. Because of this, the ink flows through the ink chamber 110. Accordingly, new ink is constantly supplied to the inside of the ink chamber 110. As described above, the ink discharge hole 108 is installed on the nozzle side relative to the ink supply hole 107. Also, the direction in which the ink flows in the ink chamber 110 is the same as the direction X (discharge direction X) in which the ink is discharged from the nozzle 111. Because of this, a force in the same direction as the discharge direction X acts on the ink in the ink chamber 110 in advance.

Next, a driving voltage is applied to the piezoelectric element 113. Accordingly, the height of the piezoelectric element 113 is increased, the capacity of the ink chamber 110 is reduced, and thus a pressure is applied to the ink in the ink chamber 110.

In this exemplary embodiment of the invention, the piezoelectric element 113 is arranged on the outside of the ink chamber 110, and displaces the vibrating plate 130 in the ink discharge direction X. Because of this, through driving of the piezoelectric element 113, a force is generated in the same direction as the ink discharge direction X as illustrated in FIG. 2. Also, as described above, as the ink flows in the ink chamber 110, a force acts on the ink in advance in the same direction as the discharge direction X. Because of this, the ink inside the ink chamber 110 is discharged by the force in the direction that acts on the ink in advance and the force that is generated as the piezoelectric element 113 is driven.

As described above, according to this exemplary embodiment of the invention, in addition to the force that is generated as the piezoelectric element 113 is driven, the force that acts on the ink in advance as the ink flows in the ink chamber 110 is used as the discharge force of the ink, and thus the discharge force can be heightened. As described above, in this exemplary embodiment of the invention, the island portion 105 is a member which is installed on the ink chamber 110, is arranged between the piezoelectric element 113 and the vibrating plate 130, and extends in a direction (one direction) in which the ink flows as illustrated in FIG. 3A. In this exemplary embodiment of the invention, a mechanism in which the island portion 105 is shaped as a member that extends in a direction in which the ink flows in the ink chamber 110 as illustrated in FIG. 6A will be described hereinafter.

Figure 3B:
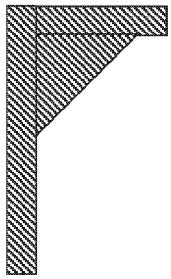
FIGS. 3A to 3C are plan views of the ink jet head according to the first exemplary embodiment of the invention.
Figure 3C:
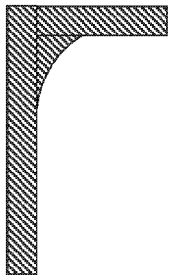
Figure 3A:
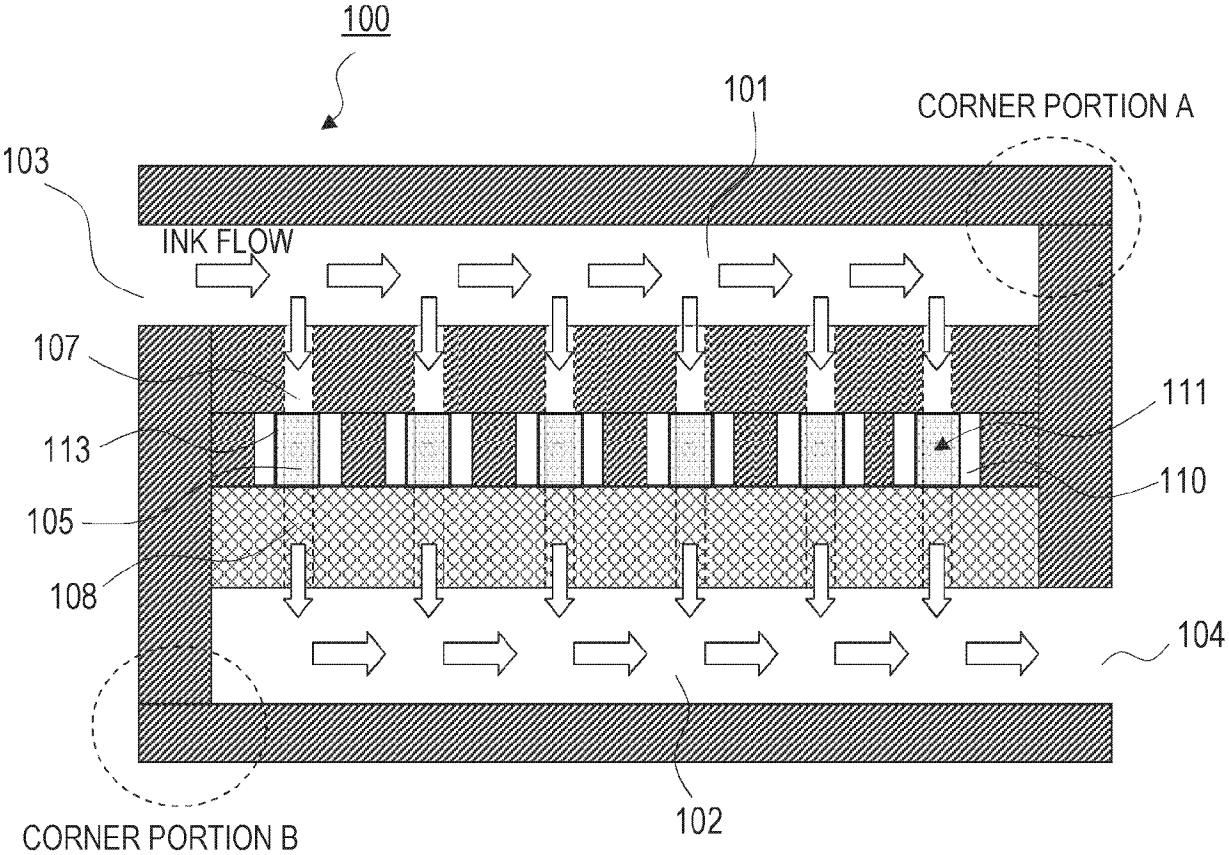
Figure 4:
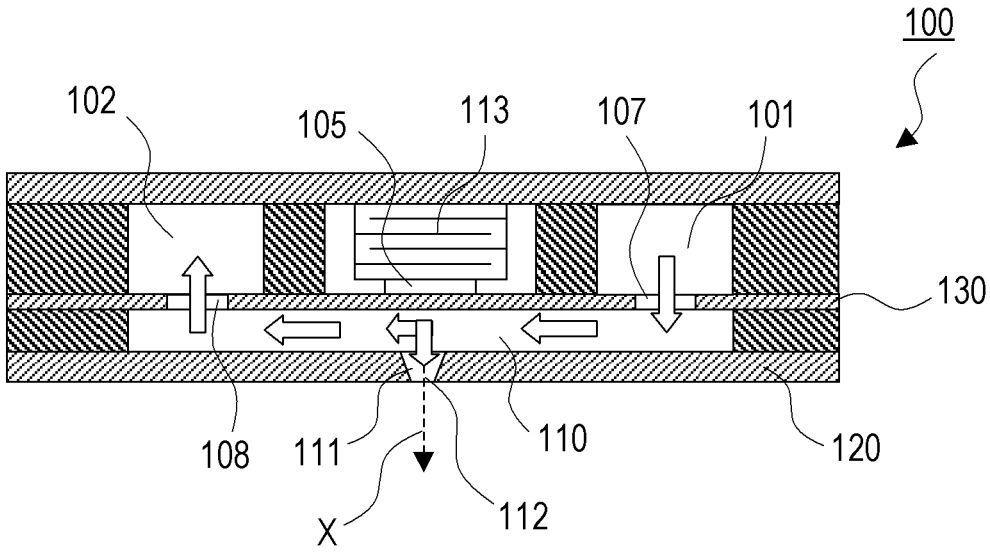
FIG. 4 is a cross-section view of a head obtained by modifying the ink jet head according to the first exemplary embodiment of the invention.
Figure 6B:
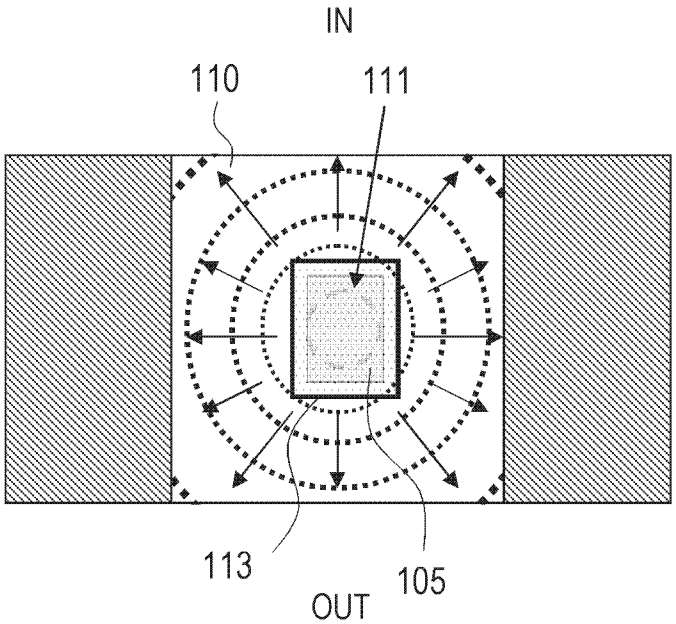
FIGS. 6A and 6B are plan views of the ink jet head illustrating the positional relationship between an ink chamber, a piezoelectric actuator, and an island portion, and ink flow when the piezoelectric actuator is driven.

FIG. 6B illustrates the positional relationship between the island portion 105 (Si projection portion) and the nozzle 111 in the technique described and depicted in FIGS. 3 and 4 of JP-A-3-015555. As described above, when the pressure is applied to the ink chamber 110 (ink pressure chamber) by the piezoelectric element 113 (piezoelectric actuator), the pressure (as indicated by an arrow in FIG. 6B) is applied in every direction, and a portion of the ink flows backward to the ink supply side IN. In the ink jet head as shown in FIGS. 3 and 4 of JP-A-3-015555, this may be a great obstacle to the discharge of the ink from the ink nozzle.

Figure 6A:
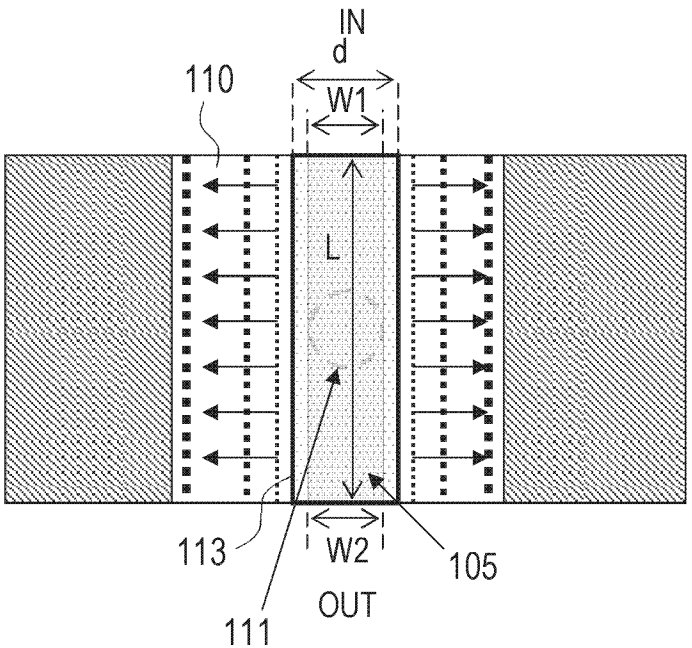

On the other hand, FIG. 6A illustrates a configuration in which the island portion 105 extends in the direction in which the ink flows in the ink chamber 110 and the piezoelectric element 113 is arranged to cover the island portion 105. Even in the configuration of the island portion 105 as illustrated in FIG. 6A, a backward flow somewhat occurs at an upstream end portion of the ink chamber 110 (end portion on the upstream side of the island portion 105) when the piezoelectric element 113 is driven. However, according to the configuration of the island portion 105 and the piezoelectric element 113 of FIG. 6A, in comparison to the case of FIG. 6B, the difference in pressure in the neighborhood of the nozzle 111 in the ink chamber 110 becomes greater, and the force for supplying the ink to the neighborhood of the nozzle 111 in the ink chamber 110 is heightened.

Specifically, in the case of FIG. 6A, if the island portion 105 is pressed due to the distortion of the piezoelectric element 113, due to the configuration of the island portion 105, not only an area neighboring the nozzle 111 in the ink chamber 110 but also the entire area in the ink chamber 110 is distorted. Also, when the piezoelectric element 113 intends to return to its original state, the ink is immediately supplied from the ink supply path 101 to the ink chamber 110 to recover the flow rate that has flowed out from the ink chamber 110.

On the other hand, in the case of FIG. 6B, in only the area neighboring the nozzle 111, the ink chamber 110 is distorted from the relationship between the configuration and the arrangement of the island portion 105. Accordingly, even in the case where the piezoelectric element 113 intends to return to its original state, the ink remains in the neighborhood of the nozzle 111 inside the ink chamber 110, and thus the force to recover the flow rate that has flowed out from the ink chamber 110 is weak in comparison to the force in the case of FIG. 6A.

Accordingly, combination of the strong discharge force and the circulation of the ink can be realized by the ink jet head as configured in FIG. 6A.

Figure 5:
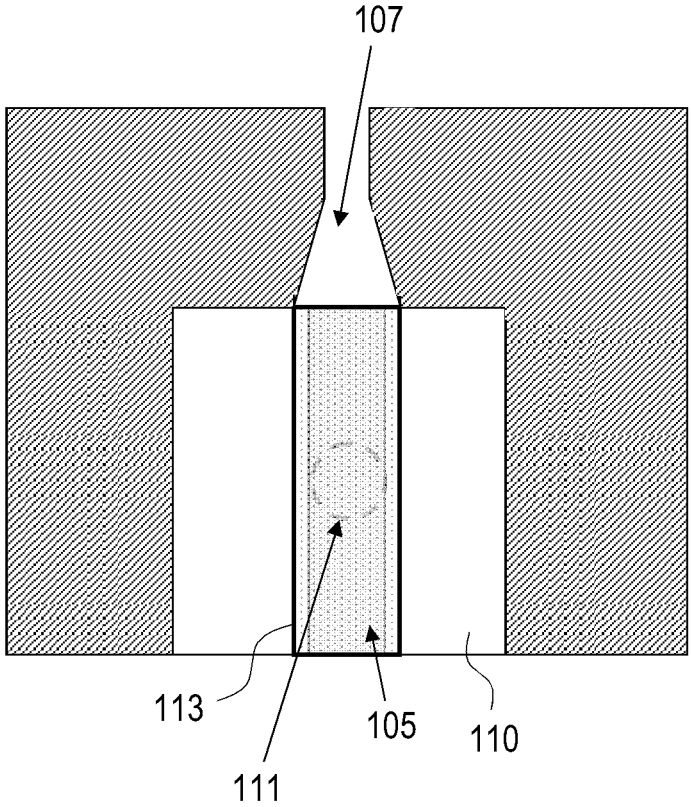
FIG. 5 is a view illustrating the shape of an ink supply hole that communicates with an ink chamber.

In this case, by changing the configuration of the ink supply hole 107 that communicates with the ink chamber 110 as illustrated in FIG. 5, the backward flow of the ink from the ink chamber 110 to the side of the ink supply hole 107 can be suppressed during the driving of the piezoelectric element 113. Specifically, a spot at which the aperture of the ink supply hole 107 is changed may be installed in at least a portion of the ink supply hole 107. Also, although not illustrated, the ink supply hole 107 which communicates with the ink chamber 110 to be bent may be configured. That is, such a bent portion causes a fluid resistance, and thus it becomes possible to suppress the backward flow of the ink from the ink chamber 110 to the side of the ink supply hole 107.

Also, as described above, in this exemplary embodiment of the invention, both the ink supply hole 107 and the ink discharge hole 108 are installed on the wall surface (to which no reference numeral is given) of the ink chamber 110 along the discharge direction X (see FIG. 2). Because of this, the ink supply hole 107 and the ink discharge hole 108 do not exist on an extended line in the direction of the force that is generated by driving the piezoelectric element 113. Accordingly, it is difficult for the force generated through the driving of the piezoelectric element 113 to pass through the ink supply hole 107 and the ink discharge hole 108. Because of this, most of the force generated through the driving of the piezoelectric element 113 is used as the discharge force of the ink.

Figure 7:
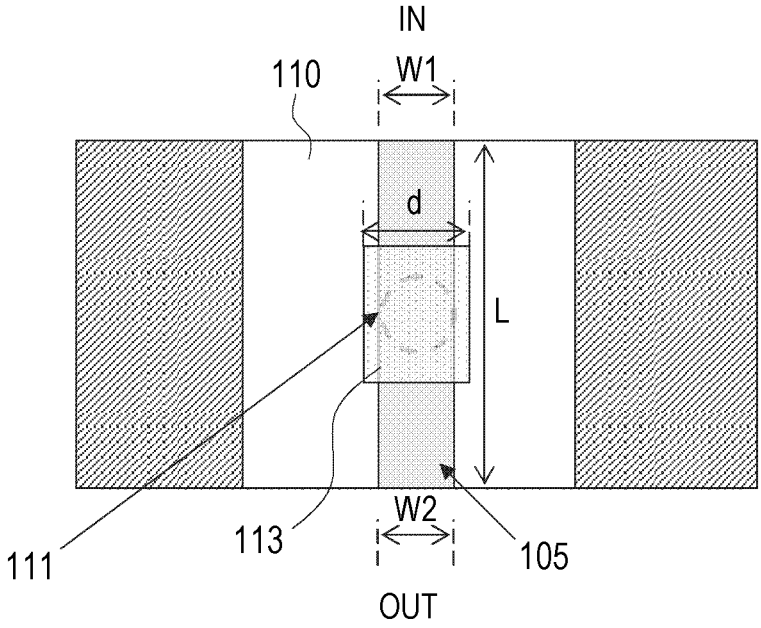
FIG. 7 is a plan view of the ink jet head according to the first exemplary embodiment of the invention.

In the above-described exemplary embodiment of the invention, the ink jet head 100 is configured so that the piezoelectric element 113 covers the entire island portion 105 as illustrated in FIGS. 3A, 6A and 6B. However, as illustrated in FIG. 7, the piezoelectric element 113 may be installed on a part of the island portion 105. In this case, it is preferable that the piezoelectric element 113 is arranged just above the nozzle 111 that corresponds to a part of the island portion 105. This is because the force, which is generated when the piezoelectric element 113 is driven, can act toward the nozzle 111, and thus it becomes easy to realize a strong discharge force of the ink.

In this case, as illustrated in FIGS. 6A and 7, if it is assumed that the length of one side of the ink supply path 101 (in FIG. 7, the side indicated by "IN") of the piezoelectric element 113 is d and the length of one side of the ink supply path 101 of the island portion 105 is W1, the inventors have found that a case where the relationship of "$d/4<W1\leq d$" is satisfied corresponds particularly to a condition where the strong ink discharge from the nozzle 111 and the circulation of the ink are combined. Further, if it is assumed that the length of one side of the ink discharge path 102 (in FIG. 7, the side indicated by "OUT") of the island portion 105 is W2, the strong ink discharge from the nozzle 111 and the circulation of the ink can be combined in the case where the relationship between the length W2 and the length d of one side of the ink supply path 101 of the piezoelectric element 113 is "$d/4<W2\leq d$". This idea has the effect in the same manner with respect to an exemplary embodiment to be described later.

<Modifications>

As a modification of the embodiment 1 as described above, an ink jet head as illustrated in FIG. 4 may be considered. That is, the ink jet head according to the embodiment 1 is configured so that the nozzle 111 is formed in a direction in which the ink flows in the ink chamber 110. However, in the modification of the embodiment 1, it may be considered that the nozzle 111 is formed on the nozzle plate 120 in a direction that is roughly perpendicular to the ink that follows from the ink supply hole 107 to the ink discharge hole 108.

In the embodiment 1 as described above, the ink is pushed from the nozzle 111 with a strong discharge force through superimposition of the force that pushes the ink in the ink chamber 110 in the direction of the nozzle 111 (or discharge hole 112) through the driving of the piezoelectric element 113 and the force of the ink that flows from the ink supply hole 107 to the ink discharge hole 108. By contrast, in the modification, the ink in the ink chamber 110 flows in a direction that is roughly perpendicular to the force that pushes the ink in the ink chamber 110 in the direction of the nozzle 111 through the driving of the piezoelectric element 113.

In the case of the ink jet head 100 in the modification, unlike the exemplary embodiment 1 of the invention, a structure that makes the ink flow in the direction of the nozzle 111 (in FIG. 2, a structure that change the ink flow roughly at right angles when the ink is supplied from the ink supply hole 107 to the ink chamber 110) is unnecessary in a leading portion of the ink chamber 110, and thus, in the case of the modification, the distance between the piezoelectric element 113 and the nozzle 111 (or the discharge hole 112) can be designed to be shortened. Because of this, in the modification, the force that pushes the ink in the ink chamber 110 from the nozzle 111 through the driving of the piezoelectric element 113 becomes stronger than that in the embodiment 1 as described above. As a result, the ink jet head 100 according to the modification can realize the ink discharge force to the extent as described in the embodiment 1.

In this case, in the ink supply flow 101 according to this exemplary embodiment of the invention, it is preferable that the lowermost downstream portion of the ink supply path 101 (a corner portion A in FIGS. 3A to 3C) has a tapered shape as illustrated in FIG. 3B or a curved shape as illustrated in FIG. 3C. This is because when the ink in the ink chamber 110 flows from the ink supply path 101, there is a possibility that the ink stays in the corner portion of the ink supply path 101. Although not illustrated, if the uppermost upstream portion of the ink discharge path 102 (a corner portion B in FIGS. 3A to 3C) has a tapered shape or a curved shape in the same manner, it is preferable on the viewpoint of ink flow.

Embodiment 2

In the embodiment 1, the island portion 105 is configured to extend in the direction in which the ink flows, and particularly, the island portion 105 is in the form of a rectangle. By contrast, in this exemplary embodiment, the island portion 105 is configured on the viewpoint of ink circulation.

Figure 8A:
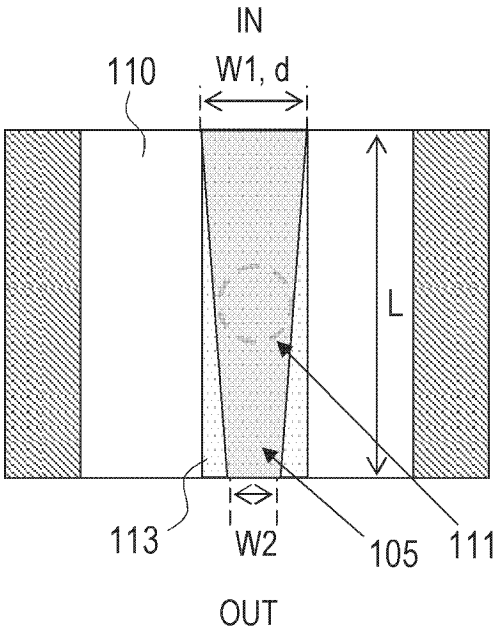
FIGS. 8A to 8C are cross-sectional views of an ink jet head according to a second exemplary embodiment of the invention.
Figure 8B:
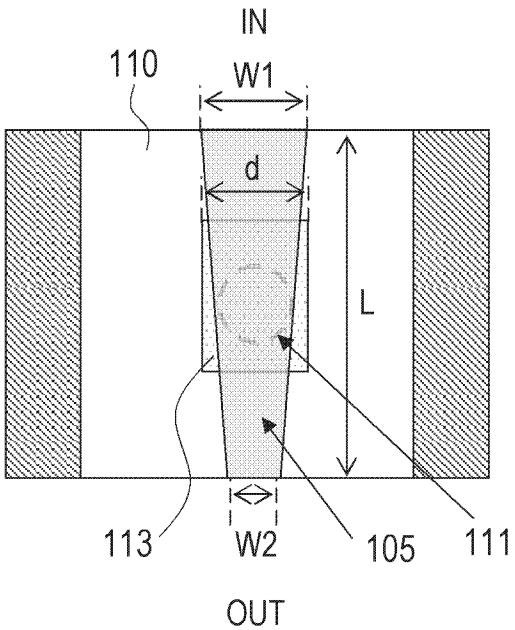
Figure 8C:
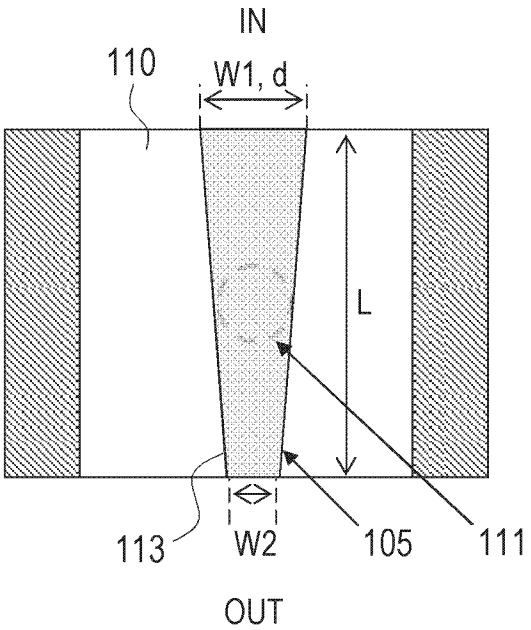

FIGS. 8A to 8C are cross-sectional views of an ink jet head 100 according to the embodiment 2 of the invention.

A difference between the ink jet head 100 as illustrated in FIGS. 3A, 6A, and 7 and the ink jet head indicated in this embodiment of the invention is that the width of the island portion 105 is gradually narrowed from the ink supply side to the ink discharge side in the ink chamber 110. The arrangement of the piezoelectric element 113 may be as illustrated in FIGS. 8A to 8C.

In FIG. 8A, the width of the island portion 105 is gradually narrowed from the upstream side to the downstream side of the ink in the ink chamber 110. Specifically, the piezoelectric element 113 is installed on an upper part of the island portion 105 (the opposite side to the direction in which the nozzle 111 is formed) to cover the entire island portion 105. In FIG. 8B, the piezoelectric element 113 is installed on an upper part of a portion of the island portion 105. In FIG. 8C, the piezoelectric element 113 that has the same configuration (combination) as the island portion 105 is installed on an upper part of the island portion 105.

In the case of the ink jet head as illustrated in FIG. 8B, it is preferable to arrange the piezoelectric element 113 just above the nozzle 111 in a part of the island portion 105.

As in this exemplary embodiment of the invention, by changing the width of the island portion 105 according to the flow of the ink (upstream/downstream), the flow of the ink (the circulation of the ink) becomes smooth. That is, by making the width of the ink upstream side of the island portion 105 wider than the width of the ink downstream side, the ink variable amount on the ink upstream side in the ink chamber 110 becomes larger than the ink variable amount on the ink downstream side to cause a difference in ink variable amount in the ink chamber 110, and thus the ink flow in the ink chamber 110 becomes smooth.

As described above, according to this exemplary embodiment of the invention, in comparison to the embodiment 1 as described above, much more effect can be achieved on the viewpoint of ink circulation. That is, by applying the configuration of the island portion 105 according to this embodiment to the embodiment 1 as described above, a preferable result can be obtained in which the ink is circulated in a very smooth manner.

Embodiment 3

This exemplary embodiment is a derivation of the embodiment 2. That is, variation on the configuration of the island portion 105 is presented in this embodiment.

Figure 9A:
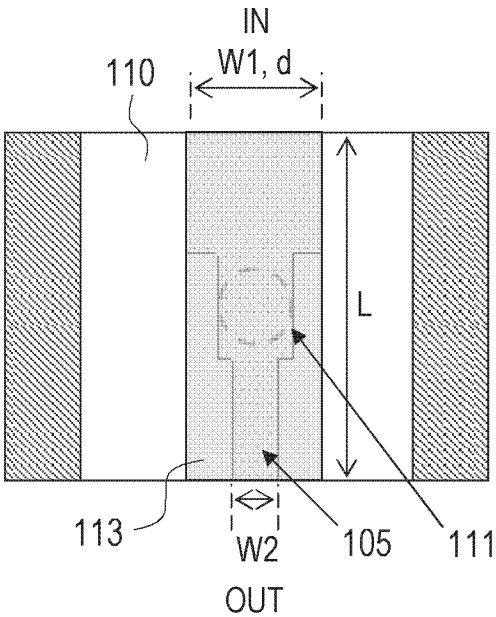
FIGS. 9A to 9C are cross-sectional views of an ink jet head according to a third exemplary embodiment of the invention.
Figure 9B:
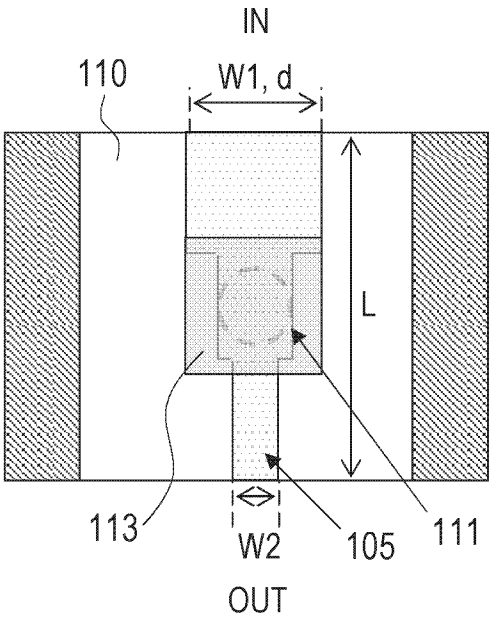
Figure 9C:
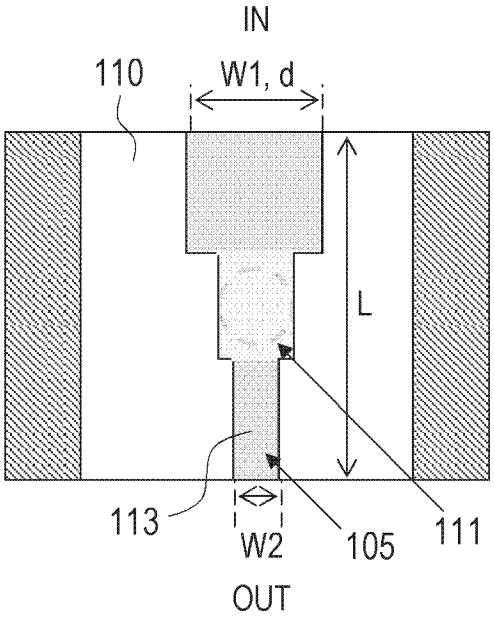
Figure 10:
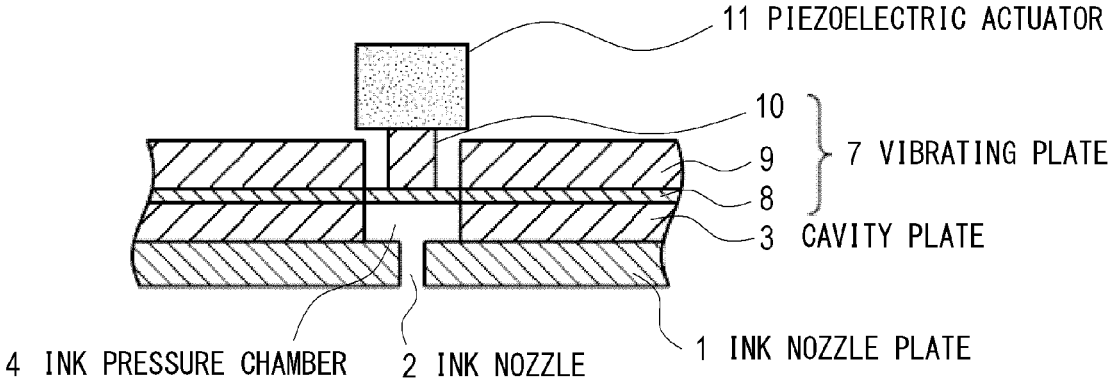
FIG. 10 is a cross-sectional view of an ink jet recording head depicted in FIGS. 3 and 4 of JP-A-3-015555.

In the embodiment 2, the island portion 105 is configured so that the width of the island portion 105 is gradually narrowed from the ink upstream side to the downstream side in the ink chamber 110. In this embodiment, as illustrated in FIGS. 9A to 9C, the island portion 105 is configured so that the width of the island portion 105 is gradually narrowed in stages from the ink upstream side to the downstream side in the ink chamber 110. In FIGS. 9A to 9C, although explanation of three variations will be omitted, the idea is the same as that as illustrated in FIGS. 8A to 8C.

In comparison to the embodiment 2, this embodiment has almost the same effect on the viewpoint of smooth ink circulation. However, in comparison to the embodiment 1, the ink circulation becomes remarkably smooth. Generally, a preferable result can be obtained by applying the configuration of the island portion 105 to the embodiment 1 as described above.

INDUSTRIAL APPLICABILITY

According to the ink jet head and the ink jet device according to the embodiments of the invention, since the ink discharge force becomes strong and the ink circulation becomes possible, the ink having high viscosity can be stably applied to an applied portion. Accordingly, for example, in manufacturing an organic EL display panel, the ink jet head and the ink jet device according to the invention can be preferably used as the ink jet head for applying and forming an organic light-emitting material.

What is claimed is:

1. An ink jet head comprising:

an ink supply path supplied with ink from an ink inlet port;

an ink discharge path configured to discharge the ink to an ink discharge port;

an ink chamber provided to communicate with the ink supply path and the ink discharge path, and having a nozzle configured to discharge the ink; and a piezoelectric actuator operable to apply pressure to the ink within the ink chamber by displacement of a vibrating plate of the ink chamber, wherein the piezoelectric actuator is arranged on an island member and the island member is arranged on the vibrating plate of the ink chamber, the island member is disposed to extend between the ink supply path and the ink discharge path, a length W1 of a side of the island member on the ink supply path side is shorter than a length L that extends from the ink supply path side to the ink discharge path side, wherein the length W1 is longer than a length W2 of a side of the island member on the ink discharge path side, and wherein a relationship between the length W1 of the side of the island member on the ink supply path side and the length W2 of the side of the island member on the ink discharge path side is represented by:

$$d/4 < W(W1, W2) \leq d$$

wherein d is a length of a side of the piezoelectric actuator on the ink supply path side.

2. An ink jet head comprising:

an ink supply path supplied with ink from an ink inlet port;

an ink discharge path configured to discharge the ink to an ink discharge port;

an ink chamber provided to communicate with the ink supply path and the ink discharge path, and having a nozzle configured to discharge the ink; and a piezoelectric actuator operable to apply pressure to the ink within the ink chamber by displacement of a vibrating plate of the ink chamber, wherein the piezoelectric actuator is arranged on an island member and the island member is arranged on the vibrating plate of the ink chamber, the island member is disposed to extend between the ink supply path and the ink discharge path, a length W1 of a side of the island member on the ink supply path side is shorter than a length L that extends from the ink supply path side to the ink discharge path side, wherein the island member is arranged just above the nozzle, wherein the length W1 is longer than a length W2 of a side of the island member on the ink discharge path side, and wherein a relationship between the length W1 of the side of the island member on the ink supply path side and the length W2 of the side of the island member on the ink discharge path side is represented by:

$$d/4 < W(W1, W2) \leq d$$

wherein d is a length of a side of the piezoelectric actuator on the ink supply path side.

3. An ink jet device comprising:

an ink jet head including:

an ink supply path supplied with ink from an ink inlet port;

an ink discharge path configured to discharge the ink to an ink discharge port;

an ink chamber provided to communicate with the ink supply path and the ink discharge path, and having a nozzle configured to discharge the ink; and a piezoelectric actuator operable to apply pressure to the ink within the ink chamber by displacement of a vibrating plate of the ink chamber, wherein the piezoelectric actuator is arranged on an island member and the island member is arranged on the vibrating plate of the ink chamber, the island member is disposed to extend between the ink supply path and the ink discharge path, a length W1 of a side of the island member on the ink supply path side is shorter than a length L that extends from the ink supply path side to the ink discharge path side, wherein the length W1 is longer than a length W2 of a side of the island member on the ink discharge path side, and wherein a relationship between the length W1 of the side of the island member on the ink supply path side and the length W2 of the side of the island member on the ink discharge path side is represented by:

$$d/4 < W(W1, W2) \leq d$$

wherein d is a length of a side of the piezoelectric actuator on the ink supply path side.

* * * * *